US011319735B1

(12) United States Patent
Montanez et al.

(10) Patent No.: US 11,319,735 B1
(45) Date of Patent: May 3, 2022

(54) SLIDING-DOOR LATCH

(71) Applicants: Michael Justin Montanez, Shelburne, MA (US); Patricia Yacovone-Biagi, Shelburne, MA (US)

(72) Inventors: Michael Justin Montanez, Shelburne, MA (US); Patricia Yacovone-Biagi, Shelburne, MA (US)

( * ) Notice: Subject to any disclaimer, the term of this patent is extended or adjusted under 35 U.S.C. 154(b) by 379 days.

(21) Appl. No.: 16/413,567

(22) Filed: May 15, 2019

Related U.S. Application Data

(60) Provisional application No. 62/673,857, filed on May 19, 2018.

(51) Int. Cl.

| | |
|---|---|
| ***E05C 3/12*** | (2006.01) |
| ***E05B 65/08*** | (2006.01) |
| ***E05B 1/00*** | (2006.01) |
| ***E05B 15/00*** | (2006.01) |

(52) U.S. Cl.
CPC ..... *E05C 3/122* (2013.01); *E05B 65/08* (2013.01); *E05B 15/0053* (2013.01); *E05B 65/0811* (2013.01); *E05B 2001/0076* (2013.01); *Y10T 292/0863* (2015.04); *Y10T 292/0889* (2015.04); *Y10T 292/0911* (2015.04); *Y10T 292/0913* (2015.04); *Y10T 292/0914* (2015.04); *Y10T 292/0915* (2015.04); *Y10T 292/0959* (2015.04); *Y10T 292/1022* (2015.04); *Y10T 292/1077* (2015.04)

(58) Field of Classification Search
CPC .. E05C 3/122; E05B 65/08; E05B 2001/0076; E05B 65/0811; Y10T 292/0959; Y10T 292/68; Y10T 292/0889; Y10T 292/0863; Y10T 292/0911; Y10T 292/0913; Y10T 292/0914; Y10T 292/0915; Y10T 292/953; Y10T 292/1022
See application file for complete search history.

(56) References Cited

U.S. PATENT DOCUMENTS

| | | | | | |
|---|---|---|---|---|---|
| 124,640 | A * | 3/1872 | Tenant | E05F 11/00 | 292/238 |
| 2,861,660 | A * | 11/1958 | Ensign | E05B 65/0811 | 49/449 |
| 3,065,985 | A * | 11/1962 | Du Four | E05B 65/0811 | 292/103 |
| 4,024,739 | A * | 5/1977 | Kaufman | E05B 65/087 | 70/97 |
| 4,480,862 | A * | 11/1984 | Fleming | E05B 65/087 | 292/150 |
| 5,676,408 | A * | 10/1997 | Davidian | E05B 65/0811 | 292/197 |
| 6,443,504 | B1 * | 9/2002 | Donald | G06K 9/00087 | 292/109 |
| 7,373,794 | B1 * | 5/2008 | DePass | E05B 9/00 | 292/195 |
| 8,517,434 | B1 * | 8/2013 | Reep, Sr. | E05B 17/2038 | 292/65 |
| 9,097,038 | B1 * | 8/2015 | Cohen | E05C 1/04 | |

(Continued)

*Primary Examiner* — Christine M Mills
*Assistant Examiner* — Faria F Ahmad

(57) ABSTRACT

A reversible apparatus for a conventional pocket door has a sliding-handle mechanism and a handle cavity sized to facilitate human operation. Moving parts are contained in a cartridge, and remain assembled, independent of the configuration of the apparatus for doors that close from left to right, or doors that close from right to left.

4 Claims, 11 Drawing Sheets

(56) References Cited

U.S. PATENT DOCUMENTS

| | | | | |
|---|---|---|---|---|
| 2007/0200370 | A1* | 8/2007 | Reithmeyer | E05B 65/087 292/340 |
| 2012/0291359 | A1* | 11/2012 | Hans | E05B 5/003 49/449 |
| 2013/0200636 | A1* | 8/2013 | Hagemeyer | E05B 1/00 292/202 |
| 2014/0210221 | A1* | 7/2014 | Mitchell | E05B 85/04 292/228 |
| 2015/0021932 | A1* | 1/2015 | Horwood | E05B 63/185 292/224 |
| 2016/0237720 | A1* | 8/2016 | Brun | E05C 19/007 |

* cited by examiner

100

100

100

100

100

100

100

200

200

SLIDING-DOOR LATCH

TECHNICAL FIELD

The present disclosure relates to locks, keys, door fittings and more specifically to fastenings for sliding doors.

BACKGROUND

A "pocket door" is a sliding door that when open is concealed in a wall. Commonly, a pocket is installed within a section of a wall adjacent to the doorway. Apparatuses for sliding the door in and out of the pocket are engaged with portions of the pocket and the door. Sliding the door along the sliding apparatus allows the door to open into the pocket such that the door does not swing through otherwise usable living space.

Latching mechanisms for sliding doors are known in the art. Standard latch and lock assemblies usually comprise latch members mounted along the stile of a door and adapted to engage with associated keeper devices mounted on an adjacent jamb.

Common mechanical locking mechanisms fit within a housing that is flush-mounted to the side of a door and has a shallow recess into which levers are fitted. Such levers require fine motor skills to actuate, as the handles for latching the door closed are constructed of small parts that are intended to not protrude from the inner or outer door surfaces, so that they may be concealed within the pocket in a wall.

Conventional mechanical locking mechanisms of the state of the art are configured with a lever on one side of the mechanism and a key hole on the opposite side. If one wanted to the door to close in the opposite direction, one would have to disassemble the mechanism and linkage components, pivots and other moving parts, and reinstall it on the opposite side of the door.

An edge pull is a device installed into the stile of a pocket door, used for sliding a door out of the pocket. A flush pull is a latching mechanism set flush with the surface of the door.

SUMMARY

A latch mechanism for a conventional pocket door is disclosed. The latch mechanism is contained in a flush-mounted housing that fits into the mortise of a conventional pocket door.

The housing provides a cavity sufficiently large to accommodate at least two fingers for moving a sliding-handle mechanism. As the handle is manipulated it actuates a linkage that moves a catch that engages with a conventional strike plate in a door jamb. The cavity also provides a means of grasping the door to slide it open or closed. A key-hole through the housing, on the side of the housing that is on the outside of the door, provides a means of unlatching the catch from the outside of the door.

A pivoting lever is also engaged with the housing on a side of the housing proximal to the stile, or edge, of the door. The lever rests flush with the edge of the door in an aperture in the housing. Pivoting the lever provides a handle for pulling the door out of its pocket.

To reverse the direction of the door latch, one would need only remove and switch the inner and outer plates of the assembly. The apparatus's moving parts are contained in the cartridge, and need not be disassembled in the process of reversing the door latch. One skilled in the art is familiar with reversing the direction of a door latch.

BRIEF DESCRIPTION OF THE DRAWINGS

FIG. 1 is a perspective view and detailed view of an example embodiment of the present disclosure mounted on a pocket door;

FIG. 2 is a right-front perspective view of an example embodiment of the present disclosure;

FIG. 3 is a left-front perspective view of an example embodiment of the present disclosure;

FIG. 4 is another right, front perspective view of an example embodiment of the present disclosure;

FIG. 5 is another right, front perspective view of an example embodiment of the present disclosure;

FIG. 6 is a left, rear perspective view of an example embodiment of the present disclosure;

FIG. 7 is a perspective, exploded view of an example embodiment of the present disclosure;

FIG. 8 is a perspective, partial section view of an example embodiment of the present disclosure;

FIG. 9 is a perspective, partial section view of an example embodiment of the present disclosure.

FIG. 10 is a perspective, partially exploded view showing the outer plate attaching to the opposite side of the cartridge as that of FIG. 5.

FIG. 11 is a perspective view showing the inner plate attached to the opposite side of the cartridge as that of FIG. 6.

DESCRIPTION

Figure 1:
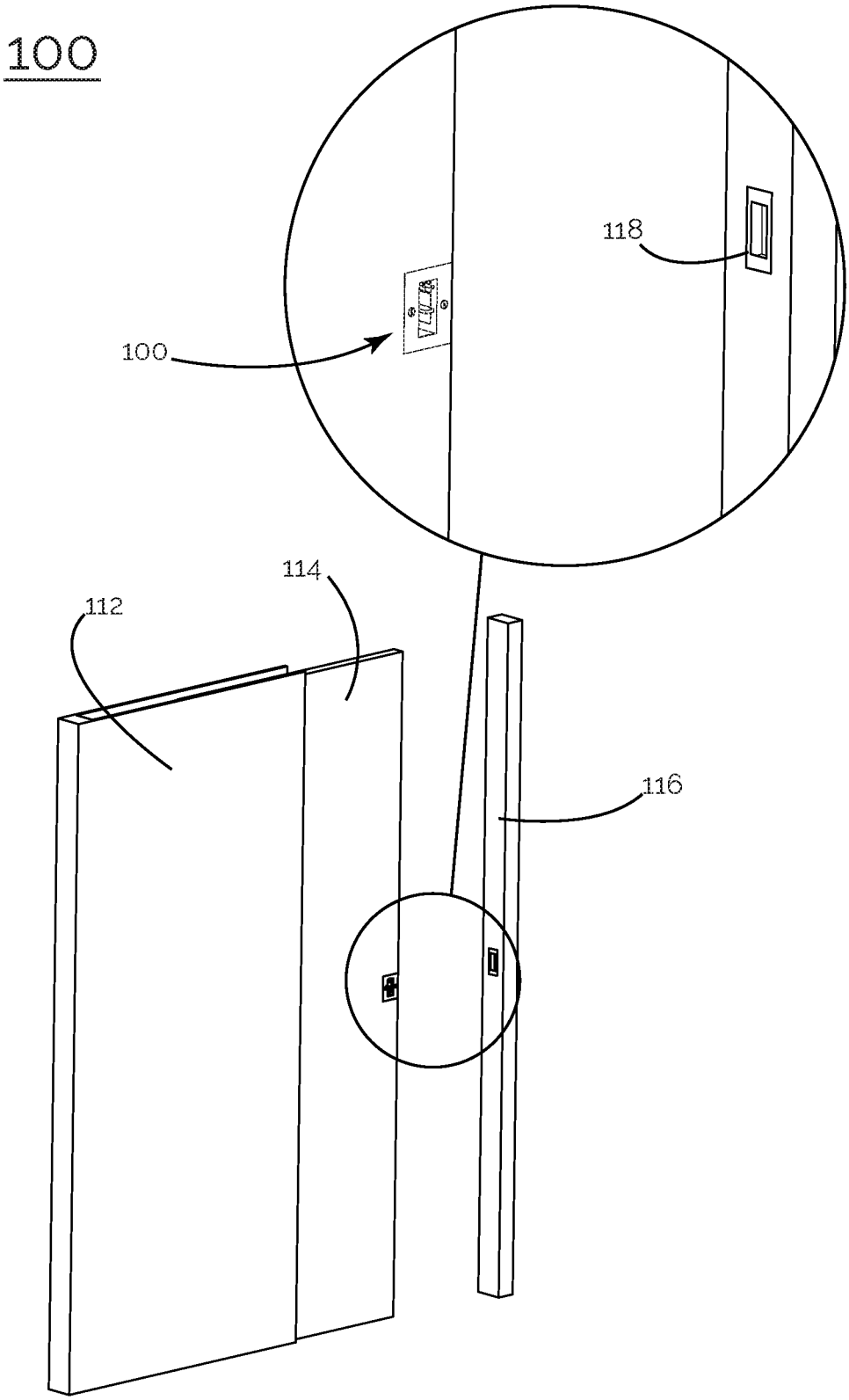
FIGS. 1-11 are presented to assist those of skill in the art, in making and using the disclosed invention and associated methods.

FIG. 1 illustrates a provided, conventional pocket door 114 sliding into its pocket 112. The strike plate 118 engages with the catch of the embodiment's mechanism. The strike plate is shown installed in a conventional door jamb 116.

Figure 2:
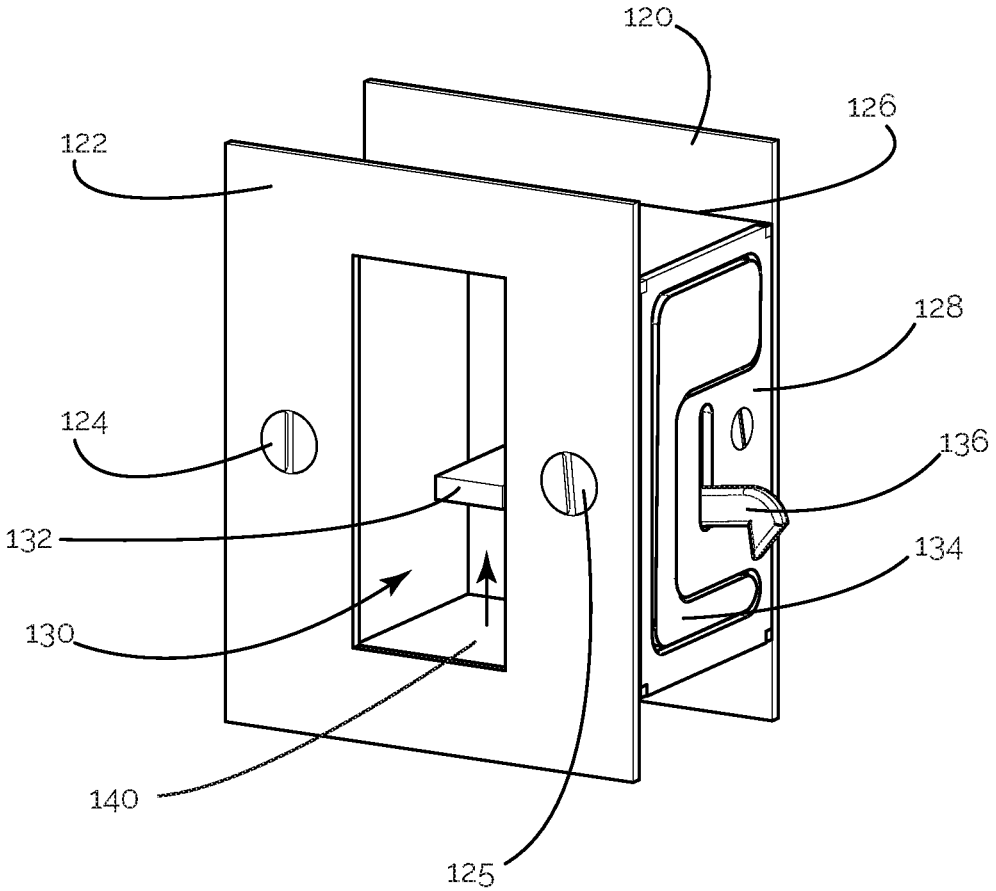
Figure 3:
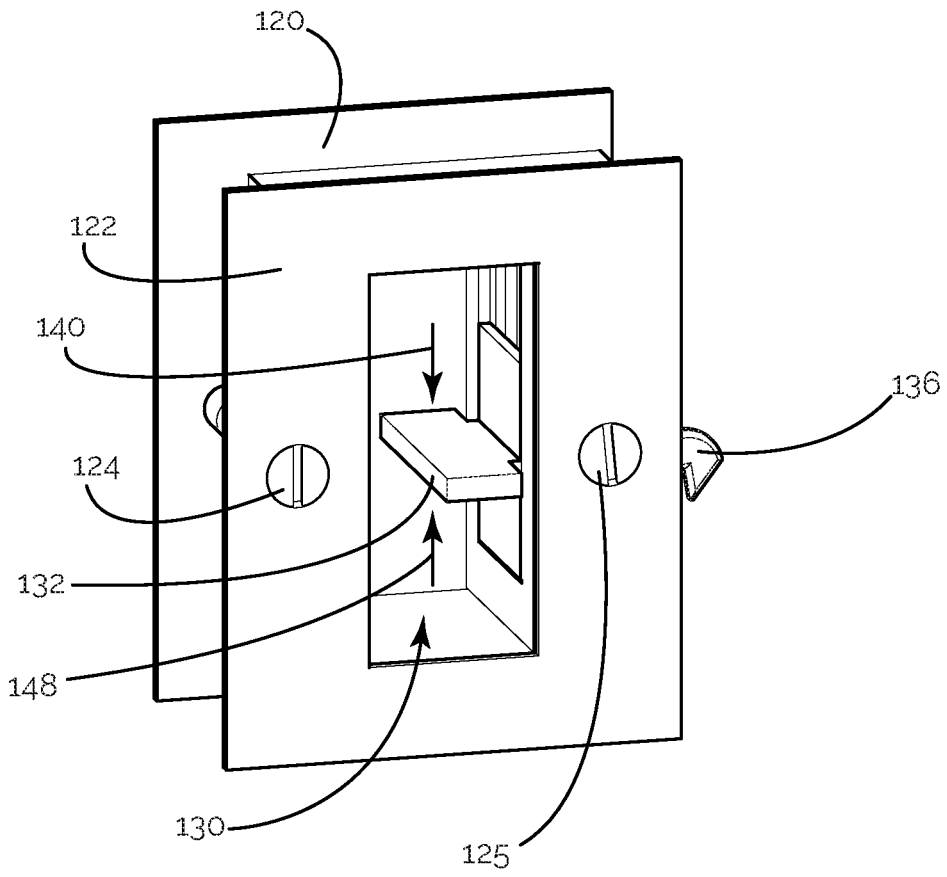

FIGS. 2 and 3 show the embodiment 100 separated from the door of FIG. 1. An outer plate 120 and an inner plate 122 are affixed to the door with screws 124 and are affixed to the cartridge 128 with machine screws 125. An outer housing 126 provides a structure for the cartridge 128 and includes a handle cavity 130 sized to admit fingers to manipulate the handle 132. As the handle 132 is manipulated upward (arrow 148) or downward (arrow 140) in the handle cavity 130, it actuates a linkage (FIG. 8, 160) that moves the catch 136 (FIGS. 2, 3) up or down so as to engage with or retract from the strike plate 118 (FIG. 1) in the jamb. The illustrations in FIGS. 2 and 3 show the embodiment with the handle 132 in the downward position (arrow 140) with the catch 136 extended to engage with a strike plate.

Figure 4:
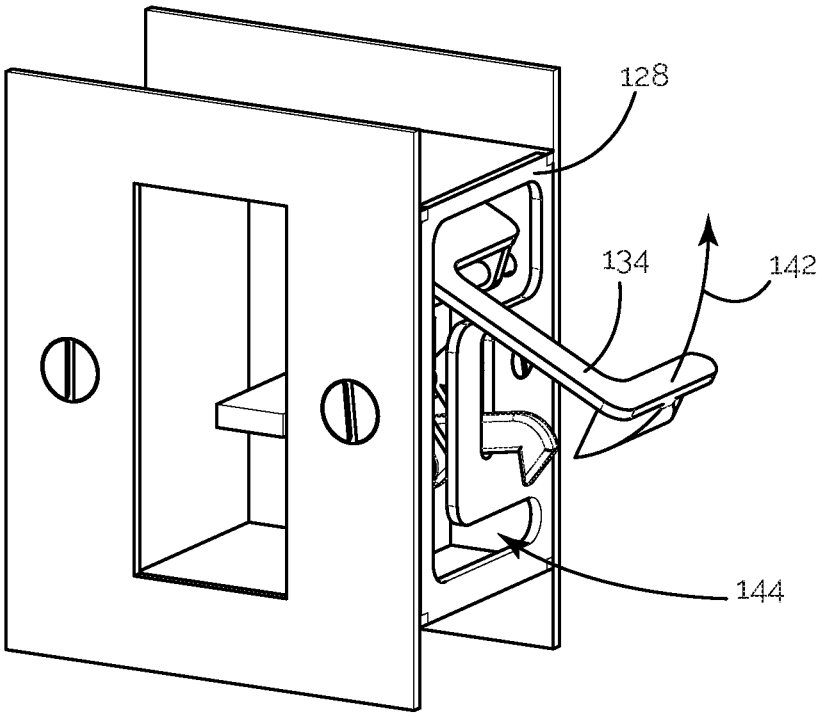

In FIG. 4, the embodiment 100 is shown with a lever 134 pivoted upward (arrow 142). The lever 134 pivots about a lever pivot shaft 152 (FIG. 7) inside the cartridge 128 (FIG. 4) and fits into the aperture cut for the lever 144. One skilled in the art is familiar with this type of flush-mounted lever.

Figure 5:
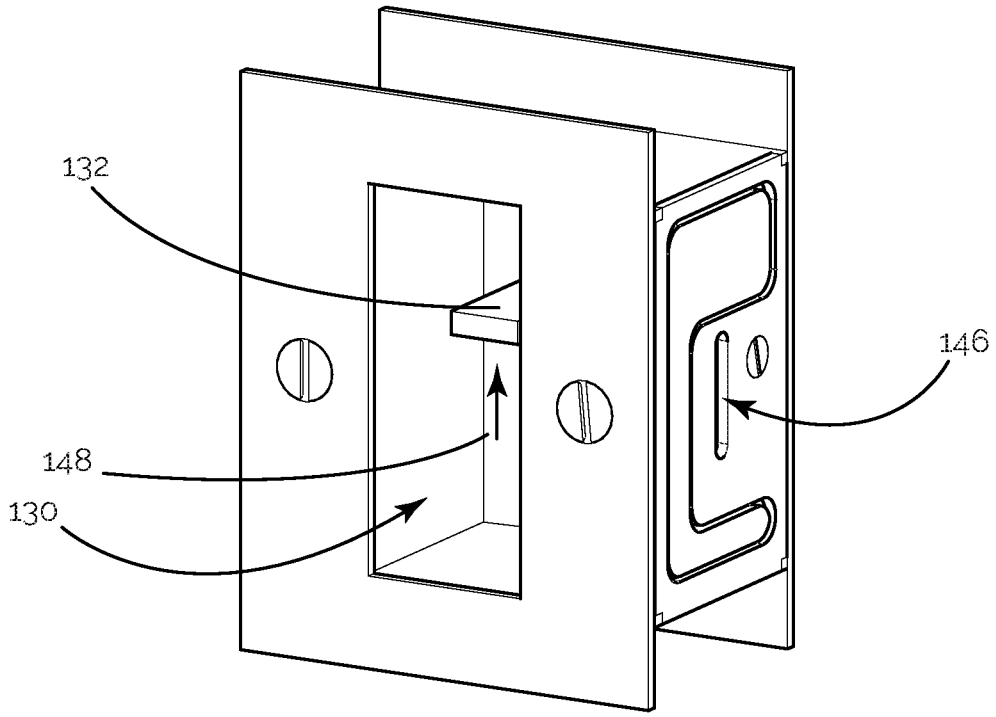

FIG. 5 depicts the retreat of the catch (FIG. 3, 136) into the slot 146 (FIG. 5) when the handle 132 is manipulated upward (arrow 148). The handle 132 is moved upward in the direction illustrated by arrow 148 as the user places fingers inside the handle cavity 130 to move the handle 132 upward.

Figure 6:
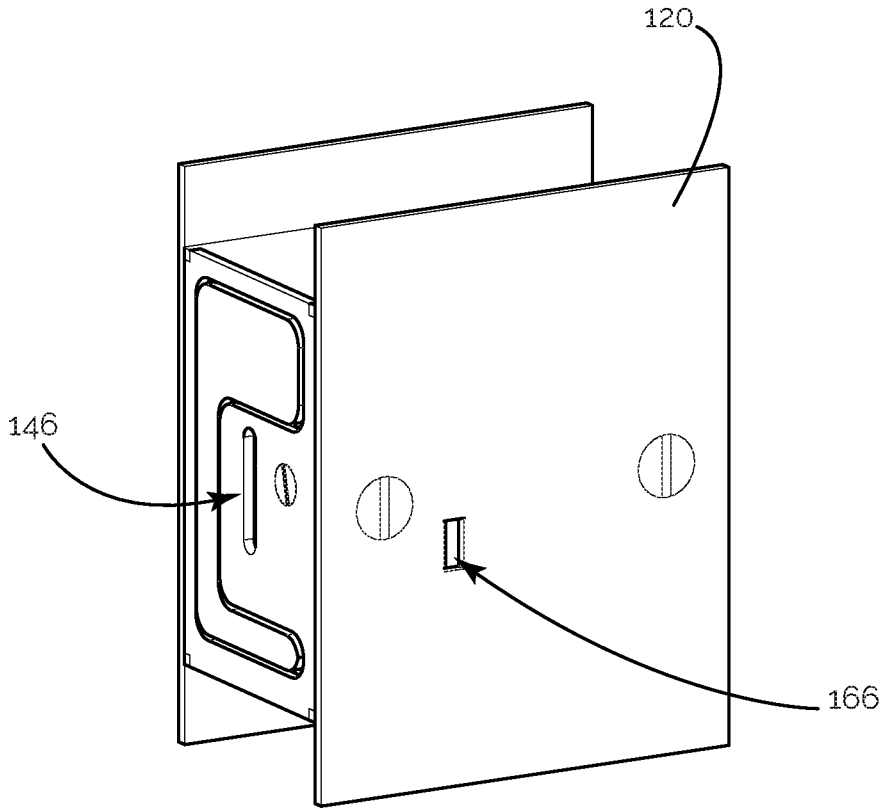

FIG. 6 shows a keyhole 166 in the outer plate 120 that is designed to receive a key or slender object to move the latch handle 132 (FIG. 5) upward to actuate the linkage (FIG. 7, 160) to retract the catch (FIG. 3, 136) through the slot 146, releasing the catch from the strike plate in the door jamb 118 (FIG. 1) to unlock the door.

Figure 7:
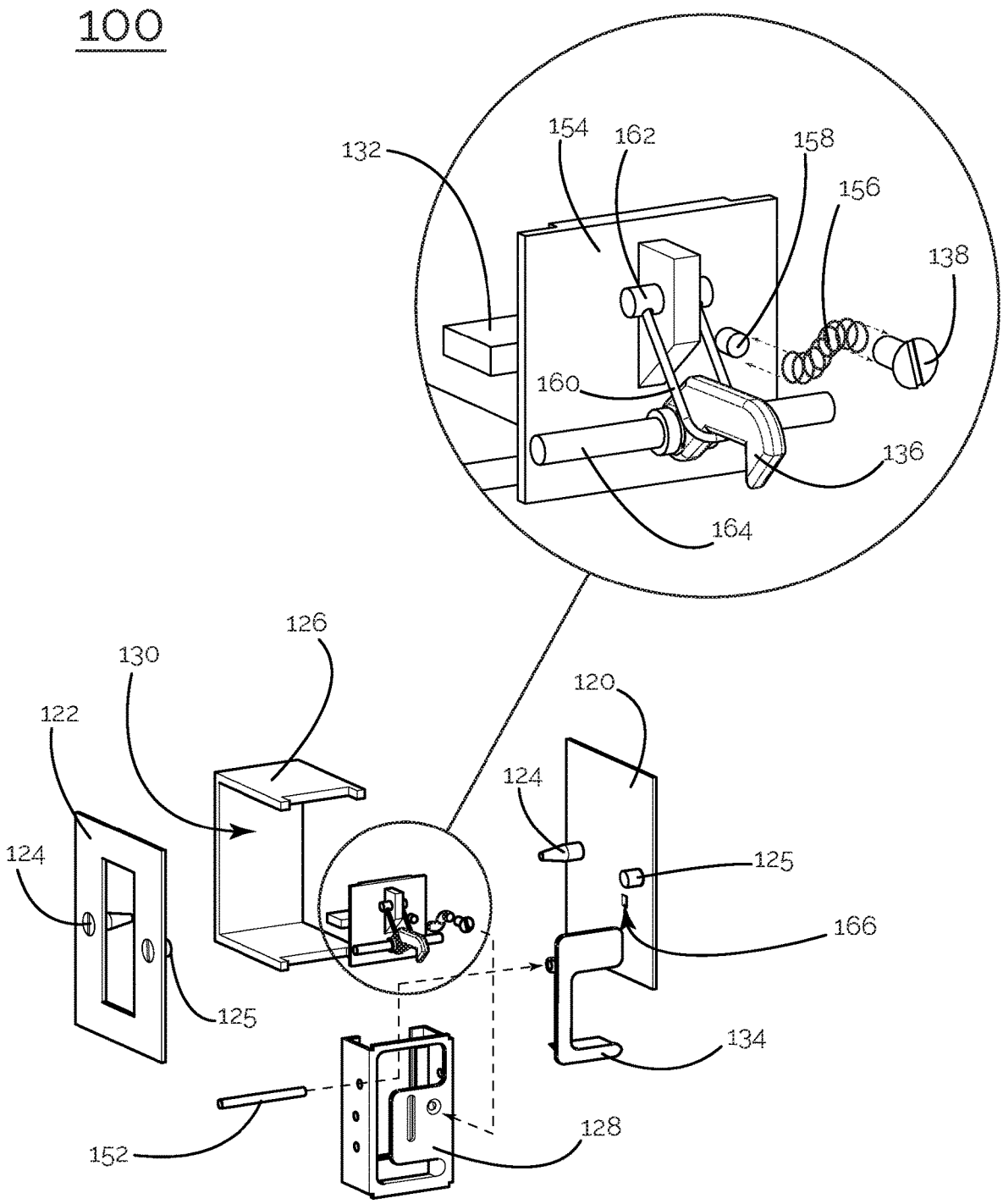

In FIG. 7 the inner plate 122 and outer plate 120 affix the embodiment to a door 114 (FIG. 1) with fasteners 124 (FIG. 7) and affix to the cartridge 128 with fasteners 125. An outer housing 126 surrounds the handle cavity 130 and the cartridge 128. The cartridge 128 supports the lever pivot shaft 152 about which the lever 134 pivots. The cartridge 128 also supports a catch pivot shaft 164 about which the catch 136 pivots. The cartridge 128 further supports a spring-mounting screw 138. A linkage 160 is engaged with a linkage pivot 162. The linkage pivot 162 is pivotally engaged with the sliding mechanism 154 which is in turn affixed to the handle 132. The linkage 160 links to the catch such that upward manipulation of the handle 132 moves the sliding mechanism 154 upward, moving the catch 136 upward as it pivots about the catch pivot shaft 164. A spring 156 is engaged with the spring mounting screw 138 at one end and at the other end with a spring-engagement protrusion 158 integral to the sliding mechanism 154.

Figure 8:
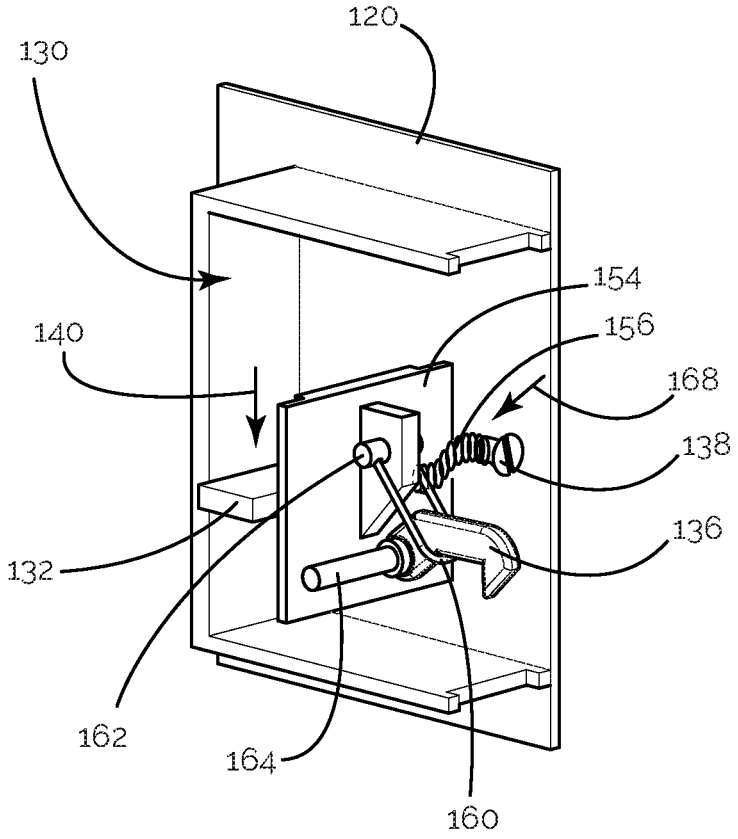

FIG. 8 shows the catch in the downward, deployed position. Some of the stationary elements have been removed to demonstrate the function of the moving parts of the embodiment's mechanism. A user inserts fingers into the latch handle cavity 130 and manipulates the handle 132 downward (arrow 140), which moves the sliding mechanism 154 downward. The spring 156 remains fixed at the end that is affixed to the spring-mounting screw 138 and bends downward, exerting a force in the direction of arrow 168 that holds the sliding mechanism 154 in the position illustrated. In this position, the linkage 160 pivots about the linkage pivot 162 and lowers the catch 136 as the catch 136 pivots about the catch-pivot shaft 164.

Figure 9:
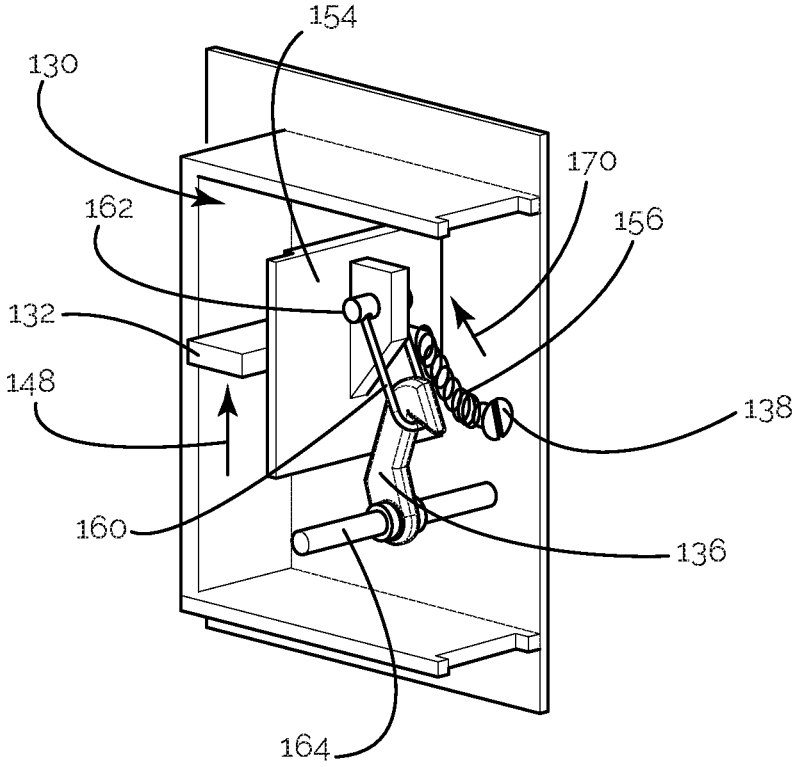

FIG. 9 illustrates the catch mechanism in the upward, retracted position. Some of the stationary elements have been removed to demonstrate the embodiment's mechanism. A user inserts fingers into the latch handle cavity 130 and manipulates the handle 132 upward (arrow 148), which moves the sliding mechanism 154 upward. The spring 156 remains fixed at the end that is affixed to the spring-mounting screw 138 and bends upward, exerting a force in the direction of arrow 170 that holds the sliding mechanism 154 in the position illustrated. In this position, the linkage 160 pivots about the linkage pivot 162 and raises the catch 136 as the catch 136 pivots about the stationary catch-pivot shaft 164.

One skilled in the art understands that that a compression spring 156 may be joined to two points that are not coaxial, and that the spring will exert a downward force when below the coaxial location and will exert an upward force when above the coaxial location. One skilled in the art also understands that other springs may be employed to exert a force in two directions allowing movement between the two directions.

Figure 10:
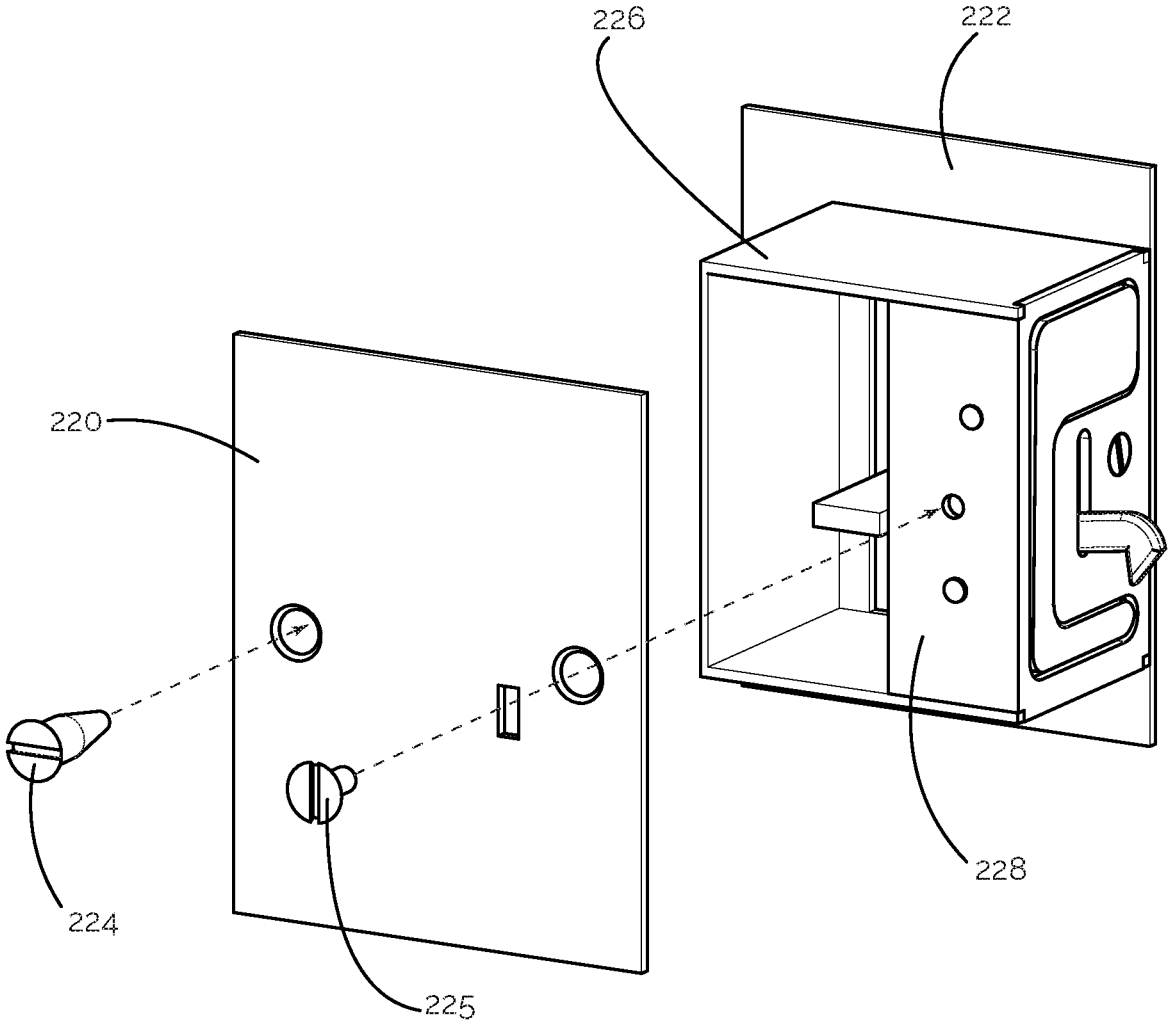

FIG. 10 illustrates the embodiment 200 which has been reversed with respect to embodiment 100. Embodiment 100 is configured for a door that closes from left to right; embodiment 200 is configured for a door that closes from right to left. One skilled in the art understands that a latch mechanism for a pocket door that closes from left to right is reversed to accommodate a door that closes in the opposite direction.

An inner plate 220 has been switched with the outer plate 222 to reverse the direction of the closure of a door with respect to the embodiment 100. The embodiment is designed such that the cartridge 228 remains affixed to an outer housing 226 while the outer plate 220 and inner plate 222 are removed, switched, and mounted to the cartridge 228 with machine screws 225. One skilled in the art understands how screws 224 mount the inner plate 220 to a door.

Figure 11:
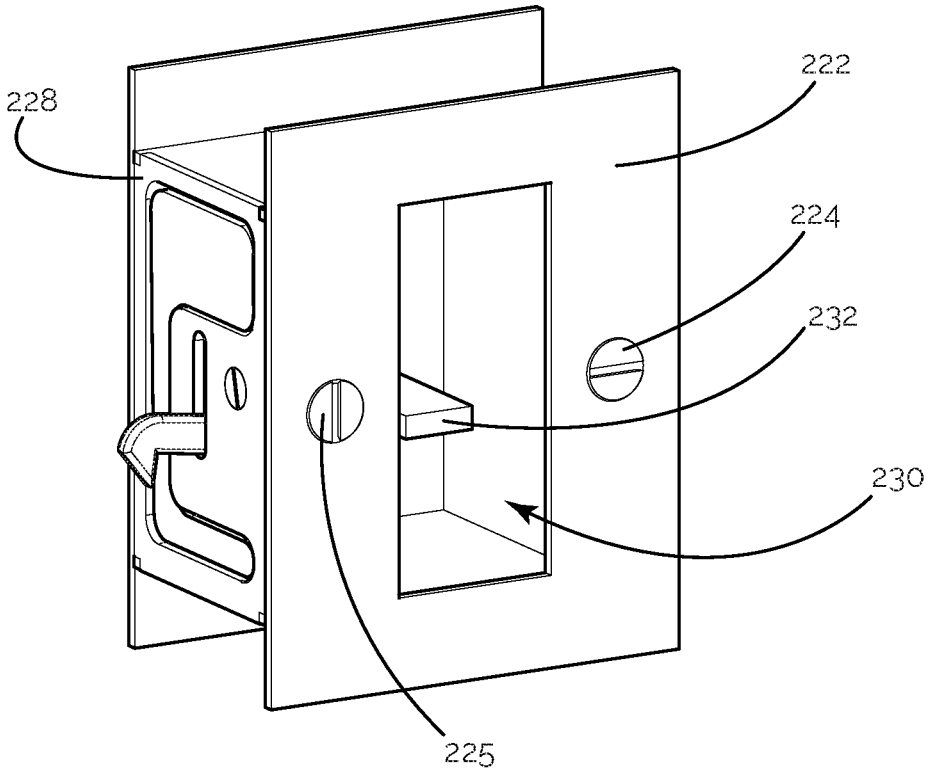

FIG. 11 illustrates the inner side of the embodiment 200 configured for a door that closes from right to left from a point of view inside the room. The inner plate 222 is mounted on the opposite side of the cartridge 228 with respect to embodiment 100. The handle 232 is accessible through a void 230 in the inner plate 222. A machine screw 225 affixes the inner plate 222 to the cartridge 228 and a wood screw 224 affixes the inner plate 222 to a door.

The invention claimed is:

1. An apparatus for latching a pocket door comprising:
a cartridge having at least three sides; and
said cartridge engaged with said pocket door; and
a sliding handle disposed within said cartridge movable between a first position and a second position; and
a linkage pivotally engaged with said sliding handle; and
said linkage slidably engaged with a catch; and
said catch pivotally engaged with said cartridge and movable between a catch-first position and a catch-second position; and
said catch-second position removably engages said catch with a strike plate; and
a spring; and
said spring fixedly engaged with said cartridge; and
movably engaged with said sliding handle; and
a first plate fixedly engaged, and flush with a first side of said pocket door, and fixedly engaged with a first side of said cartridge; and
a second plate fixedly engaged with a second side of said pocket door, and fixedly engaged with a second side of said cartridge; and
said first plate having a key-hole for inserting a key to move said sliding handle; and
said second plate having a hole extending a depth from said second plate to said first side of said cartridge, providing access to said sliding handle; wherein
movement of said sliding handle between said first position and said second position moves the catch between said catch-first position and said catch-second position by way of said linkage; said spring exerting a force holding said sliding handle in said first position and in said second position; latching said pocket door in said first position; and switching said first plate with said second plate reverses the configuration of the latch for use with a door closing in the opposite direction.

2. The apparatus of claim 1 further comprising:
a pivot axis fixedly engaged with two sides of said cartridge; and
said pivot axis pivotally engaged with said catch.

3. The apparatus of claim 1 further comprising:
a flush-mounted lever pivotally engaged with one side of said cartridge and disposed proximal to the edge of said pocket door; wherein
pivoting said lever provides a handle for pulling the pocket door out of its pocket.

4. The apparatus for latching a pocket door of claim 1, further comprising:
said linkage having a pivot point, pivotally engaged with said sliding handle; and
having a U-shaped portion extending from said pivot point around a catch returning to said pivot point; and
said linkage U-shaped portion slidably engaged with said catch; and said catch pivotally engaged with said cartridge and movable between a catch first position and a catch second position; and said catch second position removably engages said catch with a strike plate; and a compression spring having a first end and a second end; and said compression spring fixedly engaged at said first end with said cartridge; and fixedly engaged at said second end with said sliding handle; wherein movement of said sliding handle between said first position and said second position moves the catch between said catch first position and said catch second position by way of said linkage; said compression spring exerting a force holding said sliding handle in said first position and in said second position, latching said pocket door in said first position; and wherein switching the inner cover plate with the outer cover plate reverses the direction of the closure of said door.

* * * * *